US010099819B2

(12) United States Patent
Goto et al.

(10) Patent No.: US 10,099,819 B2
(45) Date of Patent: Oct. 16, 2018

(54) BAG WITH CHUCK TAPE

(71) Applicant: Idemitsu Unitech Co., Ltd., Tokyo (JP)

(72) Inventors: Shuichi Goto, Tokyo (JP); Kenichi Tanaka, Chiba (JP)

(73) Assignee: Idemitsu Unitech Co., Ltd., Tokyo (JP)

( * ) Notice: Subject to any disclaimer, the term of this patent is extended or adjusted under 35 U.S.C. 154(b) by 0 days.

(21) Appl. No.: 15/585,434

(22) Filed: May 3, 2017

(65) Prior Publication Data

US 2017/0233144 A1 Aug. 17, 2017

Related U.S. Application Data

(63) Continuation of application No. 14/645,117, filed on Mar. 11, 2015, now Pat. No. 9,669,967, which is a continuation of application No. 11/630,955, filed as application No. PCT/JP2005/011717 on Jun. 27, 2005, now Pat. No. 9,011,006.

(30) Foreign Application Priority Data

Jun. 28, 2004 (JP) ..... 2004-190078

(51) Int. Cl.
*B65D 33/00* (2006.01)
*B65D 33/25* (2006.01)
*B65D 77/32* (2006.01)

(52) U.S. Cl.
CPC ..... *B65D 33/2575* (2013.01); *B65D 33/2508* (2013.01); *B65D 33/2533* (2013.01); *B65D 77/32* (2013.01)

(58) Field of Classification Search
CPC ..... B65D 33/2575; B65D 33/2508; B65D 33/2533; B65D 77/32
(Continued)

(56) References Cited

U.S. PATENT DOCUMENTS 5,157,811 A 10/1992 Bodolay
5,375,930 A 12/1994 Kanari
(Continued)

FOREIGN PATENT DOCUMENTS

EP 0968928 A1 1/2000
JP 2749886 7/1989
(Continued)

OTHER PUBLICATIONS

Patent Abstracts of Japan, Publication No. 03-056248, Mar. 11, 1991; Abstracts of JP Appln. No. 01-189587 (Patent No. JP 2749886) filed Jul. 21, 1989.
(Continued)

*Primary Examiner* — Peter Helvey
(74) *Attorney, Agent, or Firm* — Millen, White, Zelano & Branigan, PC

(57) ABSTRACT

A bag 1 with a reclosable tape includes a reclosable tape 20 having a male fastener part 21 and a female fastener part 22 attached to one inner surface of a bag body 10, a cut tape 23 provided between mounting base parts 212 and 222 of those fastener parts, and an easily unsealable structure 50 formed on the mounting base part 212 adjacent to the cut tape 23 in an unsealing start part 30 of a side seal part 60 of the bag body. The easily unsealable structure 50 may be formed by: forming a hole portion 50*a* or a portion formed by a weak line on the mounting base part 212, arranging a thickness of the mounting base part 212 in the unsealing start part 30 so as to be thinner than other portions, or forming a non-adhesive part between the mounting base part 212 and the cut tape 23.

19 Claims, 14 Drawing Sheets

(58) Field of Classification Search
USPC ..... 383/204
See application file for complete search history.

(56) References Cited

U.S. PATENT DOCUMENTS

| | | | |
|---|---|---|---|
| 5,823,933 | A | 10/1998 | Yeager |
| 7,476,030 | B1 | 1/2009 | Kuge et al. |
| 7,597,480 | B2 | 10/2009 | Kuge et al. |
| 2005/0063624 | A1 | 3/2005 | Goto et al. |

FOREIGN PATENT DOCUMENTS

| | | | |
|---|---|---|---|
| JP | 2-141344 | U | 11/1990 |
| JP | 04-062770 | | 2/1992 |
| JP | 09-207948 | | 12/1997 |
| JP | 2002-104440 | | 10/2000 |
| JP | 2003-011986 | A | 1/2003 |
| JP | 2004-155446 | A | 6/2004 |
| WO | 03-051729 | A1 | 6/2003 |
| WO | 03-055761 | A1 | 7/2003 |

OTHER PUBLICATIONS

Patent Abstracts of Japan, Publication No. 2003-011986, Jan. 15, 2003; Abstract of JP Appln. No. 2001-200204 (Publication No. JP 2003-11986) filed Jun. 29, 2001.
Patent Abstracts of Japan, Publication No. 2002-104440, Apr. 10, 2002; Abstracts of JP Appln. No. 2000-302725 (Publication No. 2002-104440) filed Oct. 2, 2000.
Notification of Reasons for Rejection for corresponding Japanese Patent Application No. 2004-190078 (dated Jul. 28, 2009).

BAG WITH CHUCK TAPE

TECHNICAL FIELD

The present invention relates to a bag with a reclosable tape.

BACKGROUND ART

A bag provided having a reclosable tape (bag with a reclosable tape) is used as a packing material for sealing and packing various articles such as food, medical supplies, electronic components, and office supplies. Known as such bag with the reclosable tape is a bag having an arrangement in which packaging materials are overlapped and circumferential portions of those are heat sealed, in which a male fastener part is heat sealed to an inner surface of one packaging material, a female fastener part is heat sealed to an inner surface of the other packaging material along an opening edge of a bag body, and the packaging materials at a tip portion of the opening edge are adhered to each other.

The tip portion of the bag body is ripped when the bag with the reclosable tape is unsealed for the first time for taking out the content therefrom, and the bag can be reclosed and opened by fitting the male fastener part and the female fastener part to each other.

The bag with the reclosable tape requires an operation of welding the male fastener part to one packaging material, welding the female fastener part to the other packaging material, and thereafter welding the circumferential portions of the packaging materials to manufacture the bag. However, the fastener parts may not satisfactorily fit to each other after manufacture of the bag if a position of welding the male fastener part or the female fastener part on the packaging material is even slightly displaced, so there arise problems in that defective goods increase, cost increases, and the manufacturing operation becomes complicated.

In view of the above-mentioned problems, there has been proposed a bag with the reclosable tape having an arrangement in which the male fastener part and the female fastener part are attached to one packaging material so as to be fittable to each other (see, for instance, Patent Document 1). With regard to an outline of a bag 500 with a reclosable tape disclosed in Patent Document 1, FIG. 10 shows a front view of the vicinity of an unsealing start part 550, and FIG. 11 shows a cross sectional view taken along the line XI-XI of FIG. 10.

The bag 500 with the reclosable tape shown in FIGS. 10 and 11 has an arrangement in which circumferences are thermally welded to form a side seal part 600, and an upper side film 501, a male fastener part 502, a female fastener part 503 (projected portion 502*a* of the male fastener part fits into a dented part 503*a* of the female fastener part 503), a cut-out part 504 (cut tape 504), and a lower side film 505 are integrated. As shown in FIG. 11, a tab 506 is arranged on the side seal part 600. By pulling the tab 506 and the cut-out part 504 connected to the tab 506 at a time of unsealing, the upper side film 501 is pulled simultaneously to be ripped.

[Patent Document 1] Japanese Patent No. 2749886 ((Claims) and (FIGS. 1 to 8))

DISCLOSURE OF THE INVENTION

Problems to be Solved by the Invention

However, since the male fastener part and the lower side film are simultaneously ripped when the tab is pulled up in the arrangement shown in FIGS. 10 and 11 described above, a great force is required in unsealing, and thus, it may be difficult for an elder or a child to unseal.

Furthermore, there is a problem in that since the great force is required in unsealing, the male fastener part and the lower side film cannot be properly pulled up at the side seal part from the tab and a content side may be cut, which has been demanded to be improved.

Therefore, an object of the present invention is to provide a bag with a reclosable tape that does not require a great force when unsealing for the first time, that allows the unsealing operation to be performed in an easy and simple manner, and that allows reclosing and opening to be properly performed.

Means for Solving the Problems

A bag with a reclosable tape according to an aspect of the present invention includes a reclosable tape including a male fastener part and a female fastener part that are fittable with each other, is the reclosable tape attached to one inner surface of a bag body that is formed by overlapping packaging materials and bonding circumferences of the packaging materials, in which a cut tape for ripping and unsealing the bag body is arranged between a portion to which a mount base part of the male fastener part is attached and a portion to which a mounting base part of the female fastener part is attached in one packaging material provided with the reclosable tape out of the packaging materials, one mounting base part out of the mounting base parts of the male fastener part and the female fastener part is arranged along the cut tape, and an easily unsealable structure that is adjacent to the cut tape is provided in an unsealing start part of the one mounting base part, the unsealing start part formed on a side seal part of the bag body.

According to the aspect of the present invention, there can be provided the bag with the reclosable tape in which the easily unsealable structure is provided at the mounting base part (e.g., mounting base part of male fastener) adjacent to the cut tape in the unsealing start part formed with on the side seal part of the bag with the reclosable tape. When the cut tape is pulled up to rip and unseal the bag body, the mounting base part contacting the cut tape does not need to be ripped. Accordingly, unsealing is carried out with a small force, and therefore unsealing is easily carried out.

"Unsealing start part" in the present invention refers to an entire section formed from the tab and the like for unsealing the bag with the reclosable tape.

The easily unsealable structure in the bag with the reclosable tape of the present invention is preferably provided by a means (i) to a means (iii), which provides the effects described above more appropriately.

First, as for the means (i), by arranging the easily unsealable structure such that a hole portion or a portion formed by a weak line is formed in the unsealing start part of the mounting base part contacting the cut tape, the mounting base part is not ripped off from this part when the cut tape is pulled up to rip and unseal the bag body, so that unsealing can be easily and simply carried out with a small force.

"A portion formed by a weak line" refers to a portion of a predetermined shape formed by the weak line, and refers to the portion of an arbitrary shape such as a circular shape, a semicircular shape, an elliptical shape, or a polygonal shape formed by the weak line.

As for the means (ii), by arranging the easily unsealable structure such that a thickness of the mounting base part in the unsealing start part is thinner than other portions, the mounting base part is properly cut from the thinner portion and the mounting base part is not further ripped off when the cut tape is pulled up to rip and unseal the bag body, so that unsealing can be easily and simply carried out with a small force.

As for the means (iii), the easily unsealable structure includes a portion (non-adhesive portion) in which the mounting base part in the unsealing start part and the cut tape are not adhered to each other, and therefore unsealing can be easily and simply carried out with a small force without ripping off the mounting base part from the non-adhesive portion.

The bag with the reclosable tape of the present invention may have a tab that is formed in the unsealing start part described above such that an intersection of extended lines of both sides of the tab is positioned on an inner side of the side seal part, or may have a tab that is formed in the unsealing start part such that terminating points of the ripping start parts at a cut defining the tab are positioned on an inner side of the cut tape.

According to the aspect of the present invention, the tab is formed on the unsealing start part such that the intersection of the extended lines of both sides of the tab is positioned on the inner side of the side seal part or such that the terminating points of the ripping start parts at the cut forming the tab are positioned on the inner side of the cut tape. With the arrangement, the another packaging material that is not provided with the reclosable tape (e.g., the lower side film) can be prevented from being cut to the content side when being unsealed.

In the bag with the reclosable tape according to the aspect of the present invention, the easily unsealable structure is preferably provided in the unsealing start part of the above-described another packaging material that is not provided with the reclosable tape or provided in the unsealing start part of the another packaging material and the one mounting base part arranged along the cut tape. In addition, the easily unsealable structure preferably includes the hole portion and/or portion formed by a weak line that is provided on the another packaging material or provided on the another packaging material and the one mounting base part arranged along the cut tape.

According to the aspect of the present invention, since the easily unsealable structure is provided also on the unsealing start part of the another packaging material that is not provided with the reclosable tape (e.g., the lower side film), the another packaging material (e.g., lower side film) can be properly prevented from being cut to the content side, and the force required for unsealing for the first time is further reduced.

In the bag with the reclosable tape according to the aspect of the present invention, it is preferable that a width of a cut defining the tab described above becomes narrower in an unsealing advancing direction, and an angle formed by the ripping start part at the cut with respect to the unsealing advancing direction is smaller than or equal to 75 degrees.

According to the aspect of the present invention, since the width of the cut defining the tab described above becomes narrower in the unsealing advancing direction, and the angle formed by the ripping start part at the cut with respect to the unsealing advancing direction is smaller than or equal to 75 degrees, the ripping along advancement of the cut tape can be efficiently performed when the tab is pulled up for unsealing.

EXPLANATION OF CODES

Figure 1:
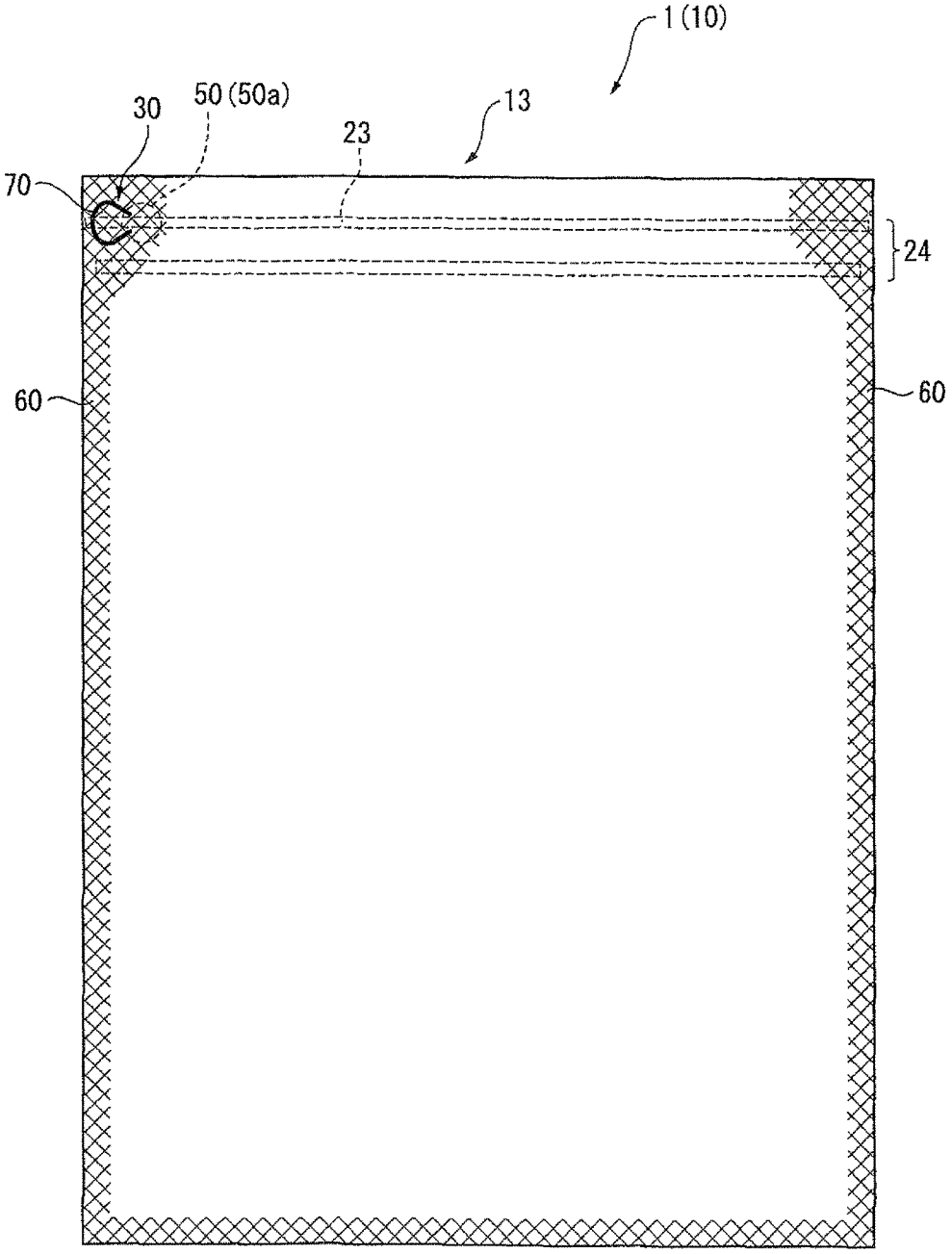
FIG. 1 is a front view showing a bag with a reclosable tape according to a first embodiment of the present invention.

1, 2 bag reclosable tape
10 bag body
11 upper side film
12 lower side film
13 opening
20 reclosable tape
21 male fastener part
22 female fastener part
23 cut tape
24 unsealing part
30 unsealing start part
50 easily unsealable structure
50*a*, 50*b* hole portion
51 non-adhesive portion
60 side seal part
70 tab
211 projected part
212 mounting base part
221 dented part
222 mounting base part
701 both sides
702 ripping start part

BEST MODE FOR CARRYING OUT THE INVENTION

Embodiments of the present invention will now be described with reference to the drawings.

First Embodiment

Figure 2:
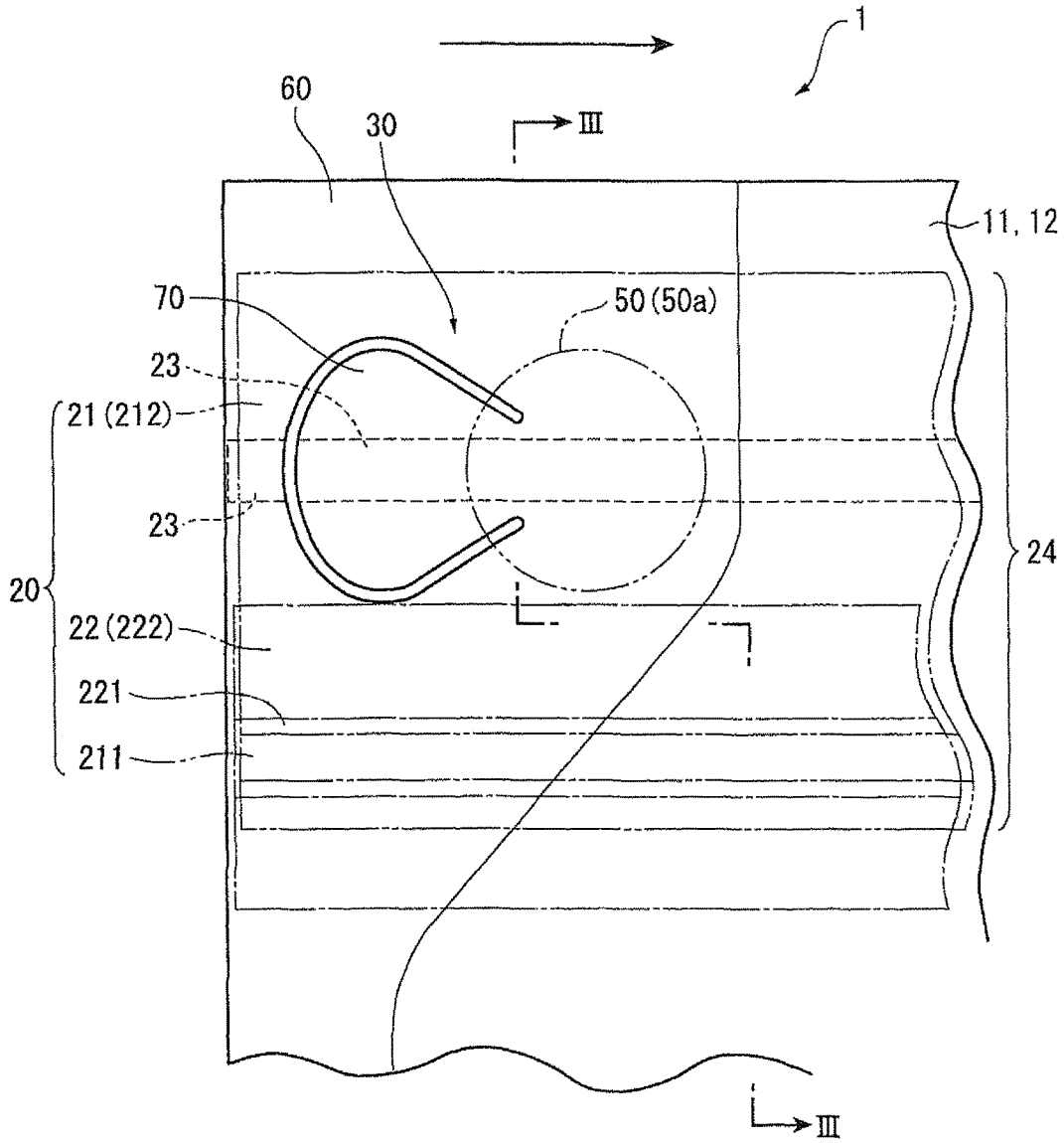
FIG. 2 is a front view showing a vicinity of an unsealing start part on which a tab is formed.
Figure 3:
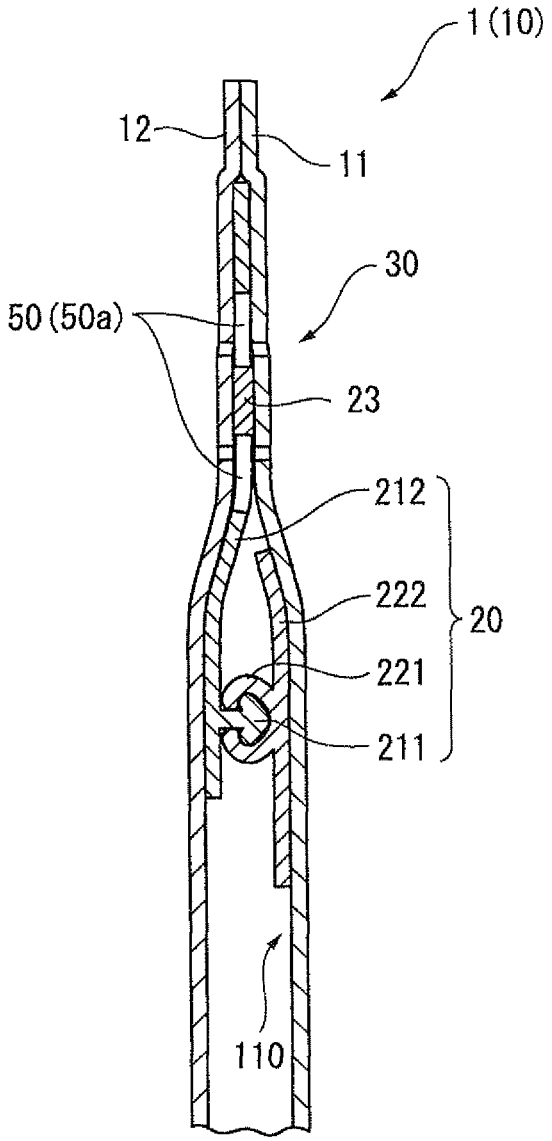
FIG. 3 is a cross sectional view taken along the line III-III of FIG. 2.

FIGS. 1 to 3 are diagrammatic views showing a bag with a reclosable tape according to a first embodiment of the present invention. Specifically, FIG. 1 is a front view, FIG. 2 is a front view of the vicinity of an unsealing start part on which a tab is formed, and FIG. 3 is a cross sectional view taken along the line III-III of FIG. 2. In FIGS. 1 to 3, reference numeral 1 denotes a bag with a reclosable tape, 10 denotes a bag body, 20 denotes a reclosable tape, 21 denotes a male fastener part, 22 denotes a female fastener part, 23 denotes a cut tape, 24 denotes an unsealing part, 30 denotes an unsealing start part, 50 denotes an easily unsealable structure, 50*a* denotes a hole portion (the easily unsealable structure), 60 denotes a side seal part, and 70 denotes a tab. The arrow of FIG. 2 indicates an unsealing advancing direction.

The bag 1 with the reclosable tape of the present invention shown in FIGS. 1 to 3 is formed by: overlapping packaging materials and bonding circumferences of the packaging materials to form the bag body 10; and attaching the reclosable tape 20 including the male fastener part 21 and the female fastener part 22 that fit with each other to one inner surface 110 of the bag body 10.

The packaging materials forming the bag body 10 are preferably formed by a single layer or a multi-layer film. For example, there can be used a single-layer or multi-layer film formed from thermoplastic resins such as oriented polyethylene terephthalate (OPET), oriented polypropylene (OPP), linear low-density polyethylene (LLDPE), polypropylene (PP), and cast polypropylene (CPP).

In addition, an aluminum deposition layer, an aluminum foil or the like may be deposited or laminated on the single-layer or multi-layer film formed from the thermoplastic resins to give the film various properties such as gas barrier property and light shielding property.

In order to form the bag body 10 using the packaging materials made up of the above-mentioned films etc., as shown in FIG. 1, two packaging materials may be overlapped, which then may be adhered and bonded to each other on three sides (two opposing sides of which define the side seal part 60) of the circumferential portions by thermal welding (heat sealing) etc. Alternatively, one packaging material may be folded to be overlapped, which then may be adhered and bonded to each other on two opposing sides (which define the side seal part 60) by thermal welding etc.

The reclosable tape 20 to be attached to the bag body 10 is adhered and fixed to the inner surface 110 of an opening 13 of the bag body 10, as shown in FIGS. 1 to 3. The adhesion between the bag body 10 and the reclosable tape 20 may be provided by thermal welding (heat sealing) or using adhesive, but the thermal welding is more preferable because of its easy and simple operation.

The reclosable tape 20 includes the male fastener part 21 and the female fastener part 22, the male fastener part 21 including a projected part 211 substantially having an arrowhead shape or a mushroom shape and a mounting base part 212 having a width wider than a mounting base part 222 of the female fastener part 22 (described later), and the mounting base part 212 with the wider width is adhered and fixed to a back surface (inner surface 110 side of the bag body 10) of an upper side film 11 by thermal welding etc. The reclosable tape 20 is formed so that the mounting base parts 212 and 222 of the male fastener part 21 and the female fastener part 22 do not overlap in an engaged state, and is welded to the inner surface of the bag body 10 without affecting a part to be engaged.

The female fastener part 22 includes a dented part 221 which fits with the projected part 211 of the male fastener part 21 described above and the mounting base part 222. The mounting base part 222 is adhered and fixed to the back surface (inner surface 110 side of bag body 10) of the upper side film 11 by thermal welding etc.

In view of formability and thermal welding property, the male fastener part 21 and the female fastener part 22 are preferably made of, for example, polyolefin resins such as a polyethylene resin (e.g., low-density polyethylene) a polypropylene resin, and a copolymer of those. The polyolefin resin can be continuously molded through a molding method such as injection molding. The thickness of the mounting base parts 212 and 222 of the male fastener part 21 and the female fastener part 22 is appropriately determined to a thickness that can provide proper flexibility of the bag 1 with the reclosable tape while securing the fitting of the projected part 211 and the dented part 221 to be fitted to each other.

In the bag 1 with the reclosable tape, the unsealing part 24 having the cut tape 23 for ripping and unsealing the bag body 10 is formed between the mounting base parts 212 and 222 of the male fastener part 21 and the female fastener part 22.

In the present embodiment, the unsealing part 24 is formed at a position where the side seal part 60 of the opening 13 of the bag body 10 to which the male fastener part 21 is attached and the cut tape 23 intersects with each other, and the cut tape 23 is adhered between the back surface of the upper side film 11 and the front surface of the mounting base part 212 of the male fastener part 21.

The cut tape 23 may be formed from oriented polyethylene terephthalate (OPET), oriented polypropylene (OPP), oriented high-density polyethylene (HDPE), etc. Adhesive or the like is applied on both surfaces of the cut tape 23, so that the cut tape 23 can be properly adhered to the back surface of the upper side film 11 and the surface of the mounting base part 212 of the male fastener part 21.

The width of the cut tape 23 is not particularly limited, but is preferably about 1 to 5 mm for allowing the bag 1 with the reclosable tape to be properly unsealed.

The bag 1 with the reclosable tape of the present embodiment has a hole portion 50*a* as the easily unsealable structure 50, the hole portion 50*a* formed on the side seal part 60 of the bag body 10, more specifically on the mounting base part 212 of the male fastener part 21, which is the mounting base part adjacent to the cut tape 23 in the unsealing start part 30 that is defined by a part in which the tab 70 (described later) for unsealing the bag 1 with the reclosable tape is formed.

A shape of the hole portion 50*a* as the easily unsealable structure 50 formed on the male fastener part 21 in the unsealing start part 30 is not particularly limited, and may be an arbitrary shape such as a semicircular shape, an elliptical shape, and a polygonal shape as well as a substantially circular shape as shown in FIG. 2.

The easily unsealable structure 50 may be formed as a so-called weak line having an arbitrary shape such as a circular shape, a semicircular shape, an elliptical shape and a polygonal shape, in addition to the hole portion 50*a*.

In addition, the easily unsealable structure 50 may be formed by combining the hole portion and the portion formed by the weak line.

The tab 70 defined by a cut is formed in the unsealing start part 30 provided on the side seal part 60 of the bag 1 with the reclosable tape.

Figure 4A:
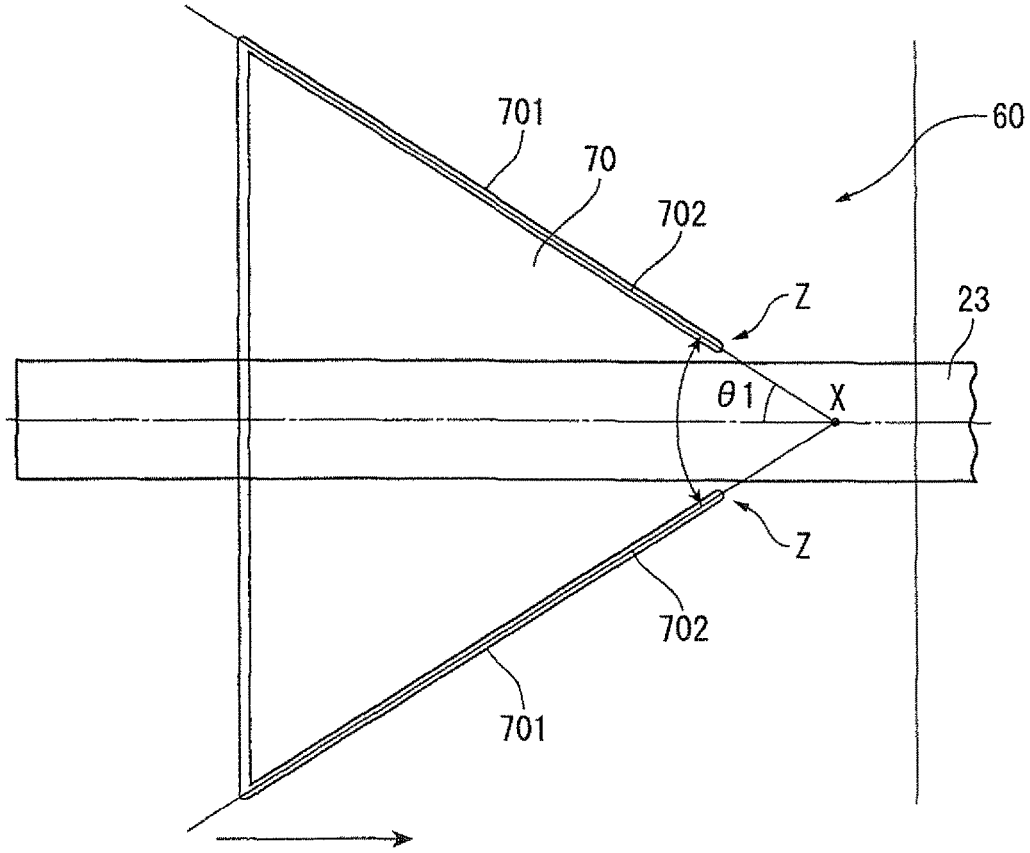
FIG. 4A is a diagrammatic view showing one example of a shape of the tab formed in the unsealing start part.
Figure 4B:
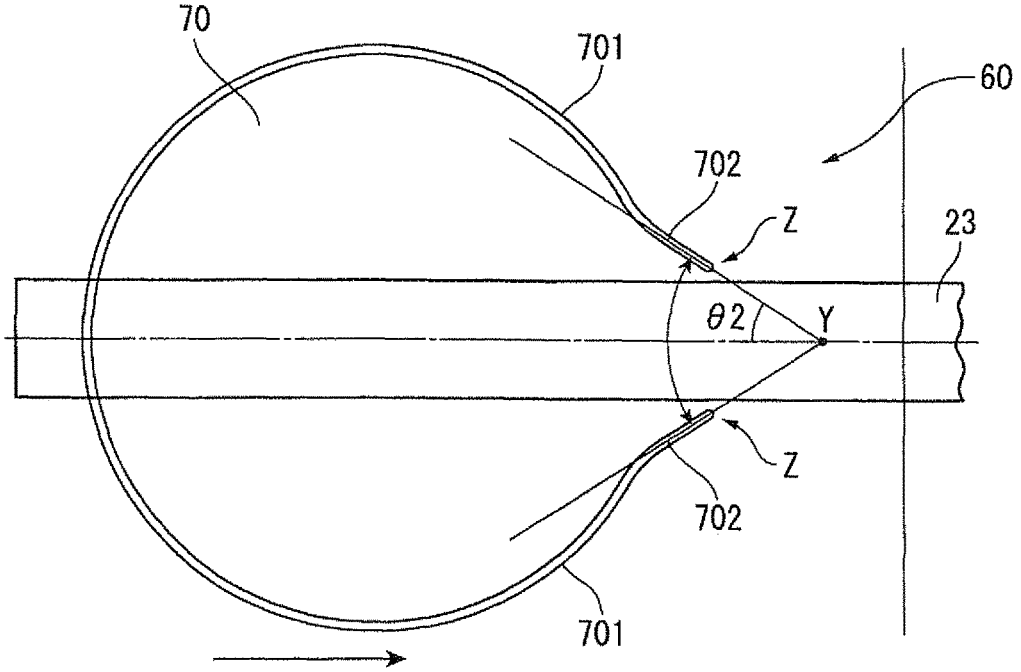
FIG. 4B is a diagrammatic view showing another example of a shape of the tab formed in the unsealing start part.

A shape of the tab 70 defined by the cut is not particularly limited but preferably be a shape that is easy to be pinched and to be pulled up, which may be, for example, a triangle as shown in FIG. 4A or a C-shape as shown in FIG. 4B. Arbitrary shapes other than those may also be employed.

As shown in FIGS. 4A and 4B, the tab 70 formed in the unsealing start part 30 is preferably arranged such that an intersection (X in FIG. 4A, Y in FIG. 4B) of extended lines of both sides 701 of the tab 70 is positioned on an inner side of the side seal part 60 in the bag 1 with the reclosable tape. Since the intersection X, Y of the extended lines of both sides 701 is positioned as described above, a lower side film 12, which is the other packaging material not provided with the reclosable tape 20, can be prevented from being cut to the content side (e.g., the right side of the side seal part 60 formed on the left side of the bag 1 with the reclosable tape in FIG. 1, and similarly, the right side of the side seal part 60 in FIGS. 4A and 4B) in unsealing.

FIGS. 4A and 4B each show a state where terminating points Z of the cut at ripping start parts 702 of the tab 70 are positioned on an outer side of the cut tape 23, but the terminating points Z may be positioned on the inner side of the cut tape 23. The lower side film 12 can be properly prevented from being cut to the content side (as described above) in unsealing even when the terminating points Z of the cut at the ripping start parts 702 are positioned on the inner side of the cut tape 23.

The ripping start parts 702 indicate ends of the cut of the tab 70, which are portions from which ripping of the packaging material of the bag body 10 starts when the tab 70 is pulled.

The width of the cut at the ripping start parts 702 of the tab 70 becomes narrower along the unsealing advancing direction as shown in FIGS. 4A and 4B. The angle formed by the cut with respect to the unsealing advancing direction (direction of the arrow in FIGS. 2, 4A, and 4B) is preferably smaller than or equal to 75 degrees, and more preferably smaller than or equal to 45 degrees. With the arrangement, the ripping of the unsealing part 24 along the advancing direction carried out by pulling up the cut tape 23 can be efficiently performed when unsealing by pulling up the tab 70.

With regard to the angle, if the ripping start part 702 is assumed to be substantially linear as in the tab 70 shown in FIGS. 4A and 4B, the extended line of the ripping start part 702 intersects with the advancing direction, and the angle may be used as it is ($\theta_1$ in FIG. 4A and $\theta_2$ in FIG. 4B).

If the ripping start part 702 is curved, a tangent line is drawn with respect to the terminating point Z of the curved cut, and the angle formed by the extended line of the tangent line and the advancing direction is preferably 75 degrees and more preferably smaller than or equal to 45 degrees.

Figure 5:
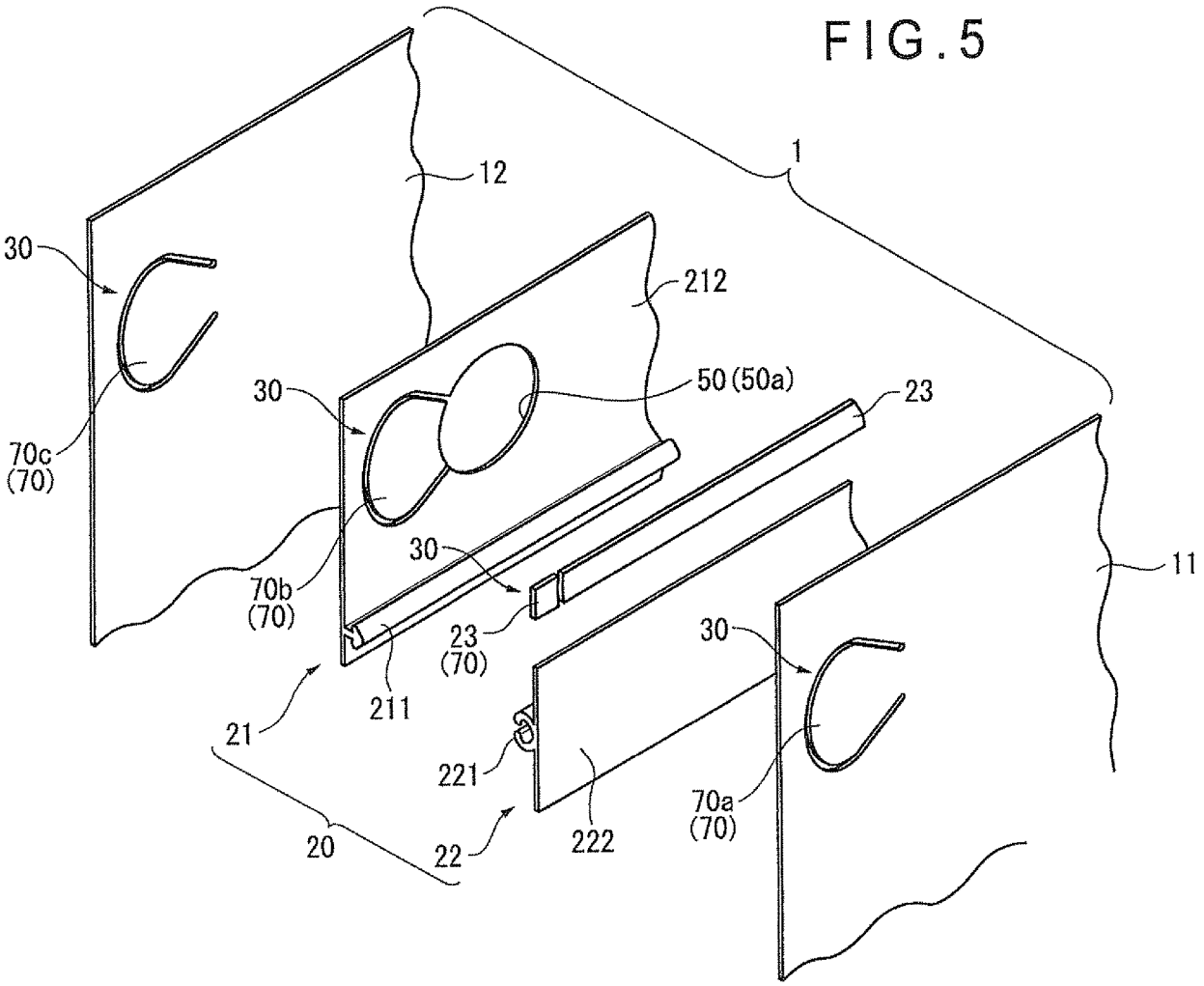
FIG. 5 is a schematic view showing an arrangement of the vicinity of the unsealing start part in the bag with the reclosable tape of the first embodiment.

FIG. 5 is a schematic view showing an arrangement of the vicinity of the unsealing start part 30 in the bag 1 with the reclosable tape of the present embodiment. The bag 1 with the reclosable tape has the upper side film 11, the female fastener part 22, the mounting base part 222, the cut tape 23, the mounting base part 212 of the male fastener part 21 having a width wider than the mounting base part 222 of the female fastener part 22, and the lower side film 12, the members being arranged in an overlapped manner.

A cut 70*a* of the upper side film 11, the cut tape 23, a cut 70*b* of the male fastener part 21, and a cut 70*c* of the lower side film 12 are laminated and adhered to each other, which forms the tab 70.

Now, a usage example of the bag 1 with the reclosable tape of the present embodiment having the above-mentioned arrangement will be described using FIGS. 5, 6A, and 6B. A user first pulls a distal end of the tab 70 formed in the unsealing start part 30 so as to form an opening on the upper side film 11 of the bag 1 with the reclosable tape (FIG. 6A) in order to take out the content from the bag 1 with the reclosable tape at the first time.

Figure 6A:
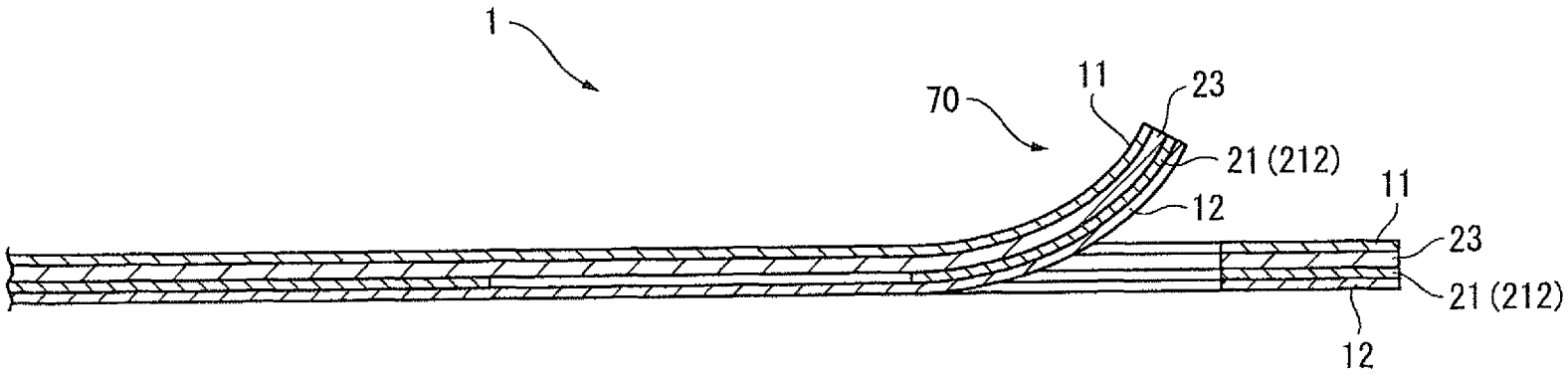
FIG. 6A is a schematic view showing an unsealed state of the bag with the reclosable tape of the first embodiment.
Figure 6B:
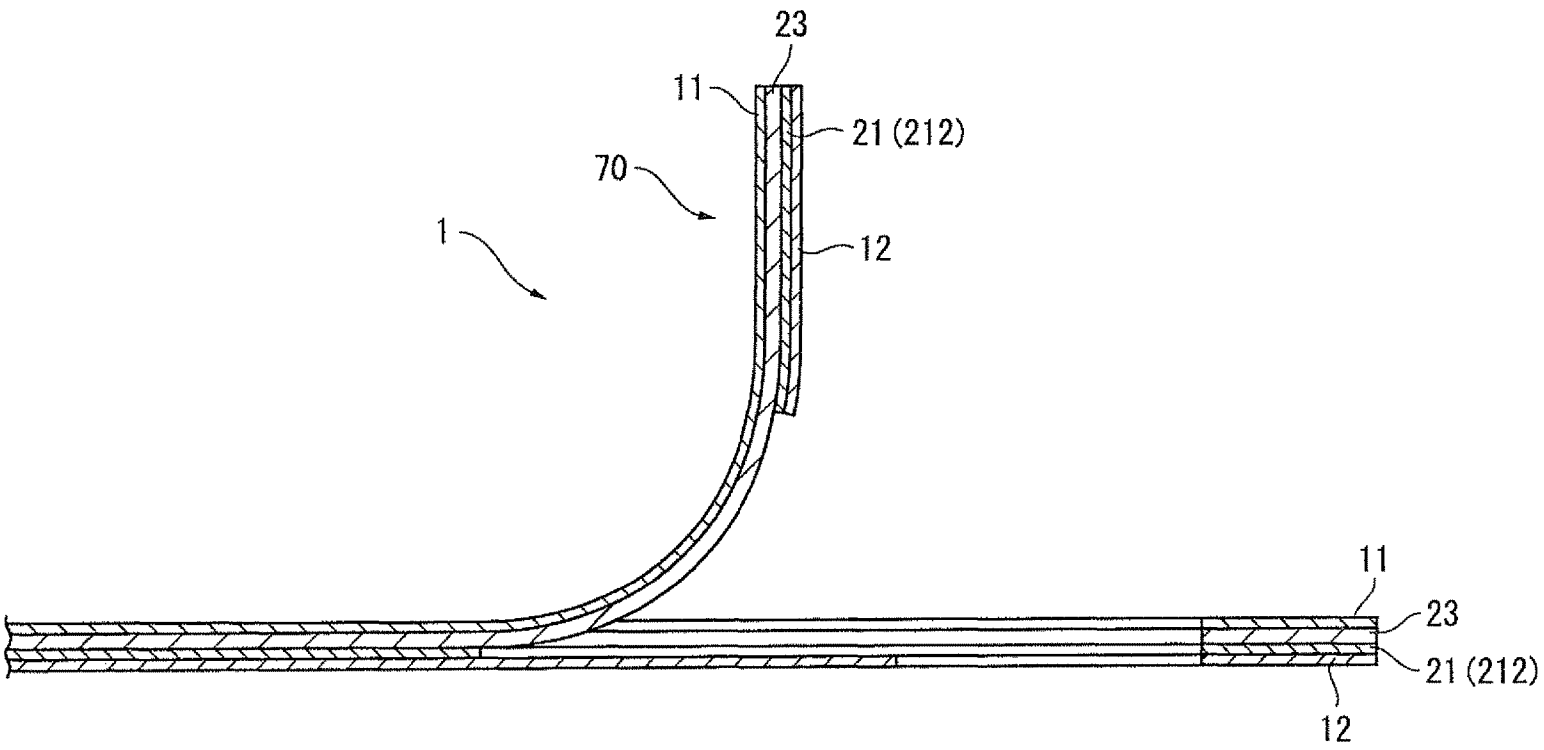
FIG. 6B is a schematic view showing advancement of the unsealed state of the bag with the reclosable tape of the first embodiment.

The upper side film 11, the cut tape 23, the mounting base part 212 of the male fastener part 21 and the lower side film 12 which are adhered together are simultaneously pulled when the tab 70 is pulled as described above, and the cut tape 23, the upper side film 11 and the lower side film 12 of the unsealing start part 30 are ripped and the opening is formed as the ripping advances, without causing the mounting base part 212 of the male fastener part 21 to be ripped off since the hole portion 50*a* is formed as the easily unsealable structure 50 on the mounting base part 212 of the male fastener part 21 (FIG. 6B). With such a method, a force required to form the opening is minimized, so that the unsealing is easily performed.

Accordingly, the bag body 10 is in an open state when the user releases the fitting of the projected part 211 of the male fastener part 21 and the dented part 221 of the female fastener part 22, and the bag body 10 is in a sealed state when the projected part 211 of the male fastener part 21 and the dented part 221 of the female fastener part 22 are engaged.

One example of a method of manufacturing the bag 1 with the reclosable tape of the present embodiment will now be described. The male fastener part 21 and the female fastener part 22 are first molded through injection molding or the like, and thereafter, the hole portion 50*a* (the easily unsealable structure 50) is formed on the mounting base part 212 of the male fastener part 21.

The male fastener part 21 and the female fastener part 22 are provided to the packaging material of the bag body 10 in a fitted state, and the bag body 10 and both fastener parts 21 and 22 are thermally welded and fixed by thermal welding or the like, awhile attaching the cut tape 23 to the bag body 10 at the middle of positions to which both fastener parts 21 and 22 are thermally fixed.

After the male fastener part 21 and the female fastener part 22 are welded and fixed on the packaging material, another sheet of packaging material is overlapped. Then, bottom parts of the circumferences of the packaging materials are adhered by thermal welding or the like, and both sides are adhered by thermal welding or the like to form the side seal part 60, thereby forming the bag 1 with the reclosable tape in which the adhesion is provided on three sides excluding the opening 13.

After the content is charged into the bag body 10 from the opening 13 as necessary, adhesion is provided for the opening 13 by thermal welding or the like, and the bag 1 with the reclosable tape filled with the content in a sealed state is obtained.

According to the bag with the reclosable tape of the present embodiment, the following advantages can be obtained.

(1) Since the hole portion 50*a* or the portion formed by a weak line is formed as the easily unsealable structure 50 of the male fastener part 21 in the unsealing start part 30 formed on the side seal part 60 of the bag 1 with the reclosable tape, the mounting base part 212 of the male fastener part 21 contacting the cut tape 23 is not required to be ripped off when the cut tape 23 is pulled up to rip and unseal the bag body 10, so that unsealing can be carried out with a small force and with ease.

(2) Since the tab 70 is formed on the unsealing start part 30 so that the intersection of the extending lines of both sides 701 of the tab 70 is positioned on the inner side of the side seal part 60 or so that the terminating points of the ripping start parts 702 at the cut forming the tab 70 are positioned on the inner side of the cut tape 23, the lower side film 12 can be prevented from being cut to the content side in unsealing.

(3) It is so arranged that the width of the cut defining the tab 70 in the unsealing start part 30 becomes narrower in the unsealing advancing direction and the angle formed by the ripping start part 702 at the cut with respect to the unsealing advancing direction is smaller than or equal to 75 degrees. With the arrangement, the ripping along the advancement of the cut tape 23 is efficiently performed when the tab 70 is pulled up to unseal.

Second Embodiment

A second embodiment of a bag with a reclosable tape of the present invention will now be described with reference to the drawings.

In the first embodiment described above, the easily unsealable structure 50 formed in the unsealing start part of the bag 1 with the reclosable tape is provided by forming the hole portion 50*a* on the mounting base part 212 of the male fastener part 21.

Figure 7:
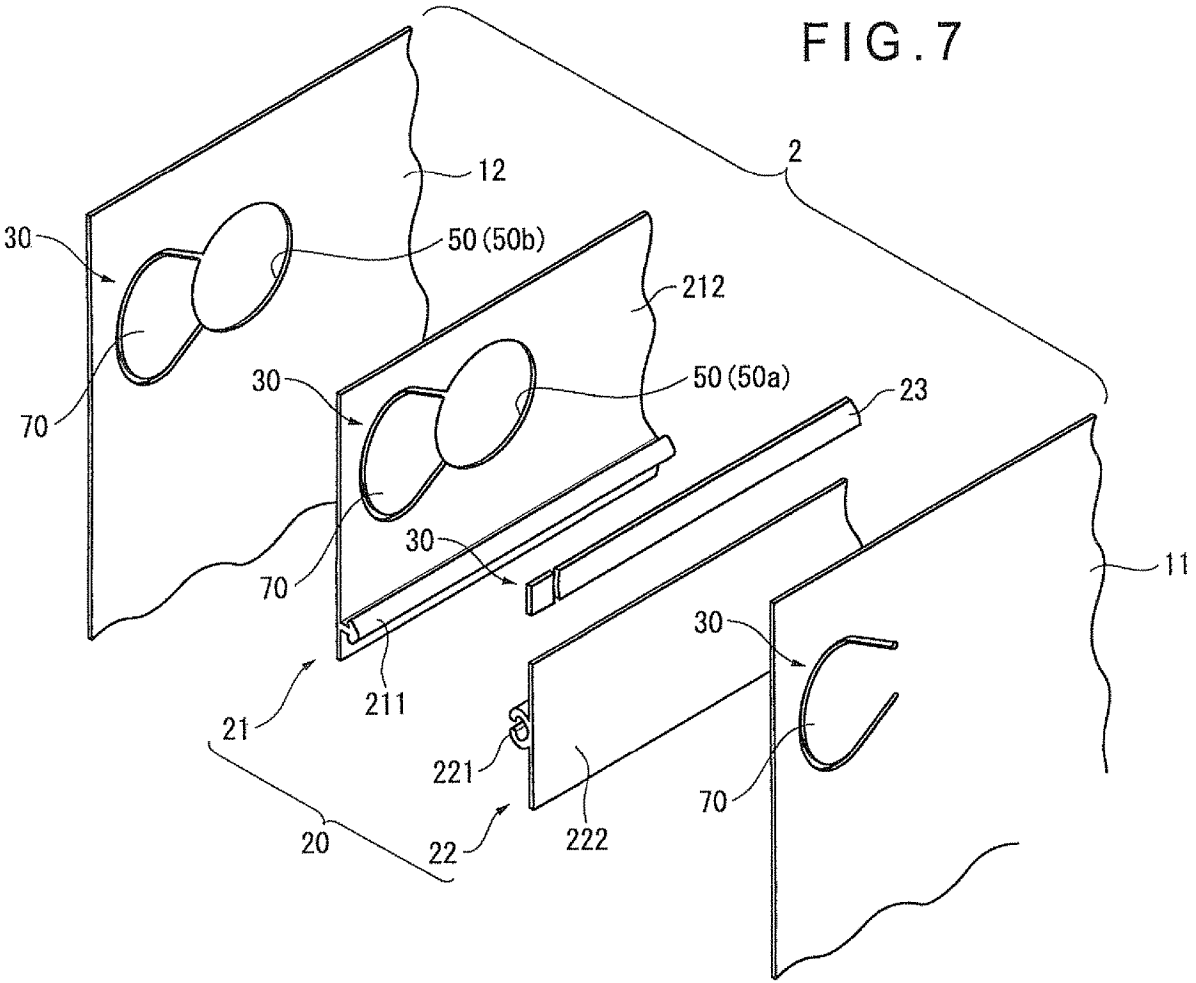
FIG. 7 is a schematic view showing an arrangement of the vicinity of an unsealing start part of a bag with a reclosable tape according a second embodiment of the present invention.

The bag 2 with the reclosable tape of the second embodiment differs in that the hole portion is also formed on the lower side film 12 in addition to the mounting base part 212 of the male fastener part 21 in the unsealing start part 30 as shown in FIG. 7.

In the following description, the same parts and the same members as those described in the first embodiment are indicated by the same reference numerals to omit the description thereof.

FIG. 7 is a schematic view showing an arrangement of the vicinity of the unsealing start part 30 of the bag 2 with the reclosable tape in the second embodiment of the present invention.

Comparing the arrangement of FIG. 7 with the arrangement of FIG. 5 (first embodiment), the bag 2 with the reclosable tape of the present embodiment is the same as the bag 1 with the reclosable tape of the first embodiment in that the upper side film 11, the mounting base part 222 of the female fastener part 22, the cut tape 23, the mounting base part 212 of the male fastener part 21 having a width wider than the female fastener part 22, and the lower side film 12 are arranged in an overlapped manner, but differs in that a hole portion 50*b* is also formed in the unsealing start part 30 of the lower side film 12 in a manner similar to the mounting base part 212 of the male fastener part 21.

As shown in FIG. 5 or FIGS. 6A and 6B, the tab 70 is likely formed also on the lower side film 12 when the tab 70 defined by a cut is formed in the unsealing start part 30 of the bag 1 with the reclosable tape, and the tab 70 formed on the lower side film 12 is also pulled when the distal end of the tab 70 is pulled.

Figure 8A:
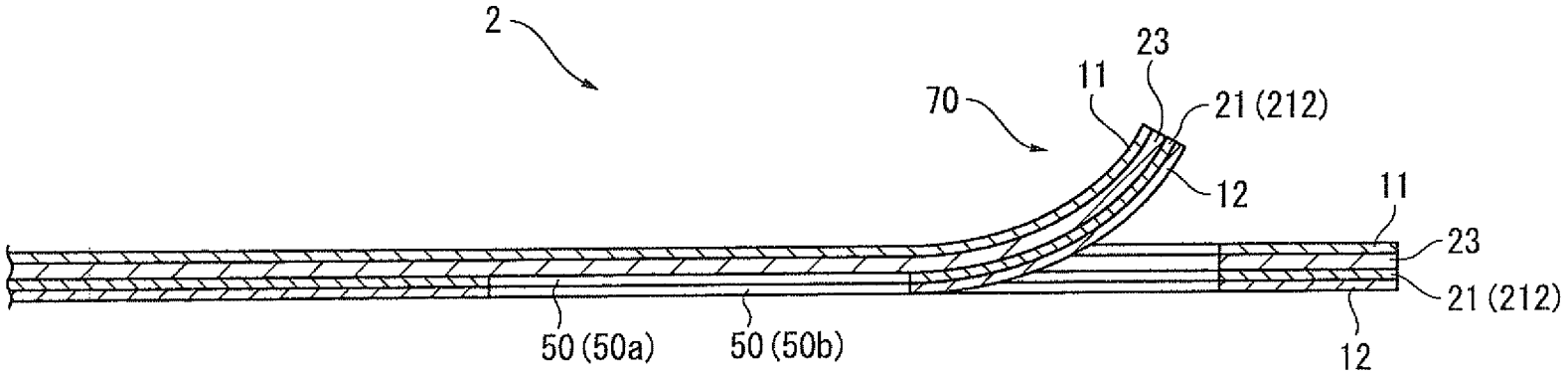
FIG. 8A is a schematic view showing an unsealed state of the bag with the reclosable tape of the second embodiment.
Figure 8B:
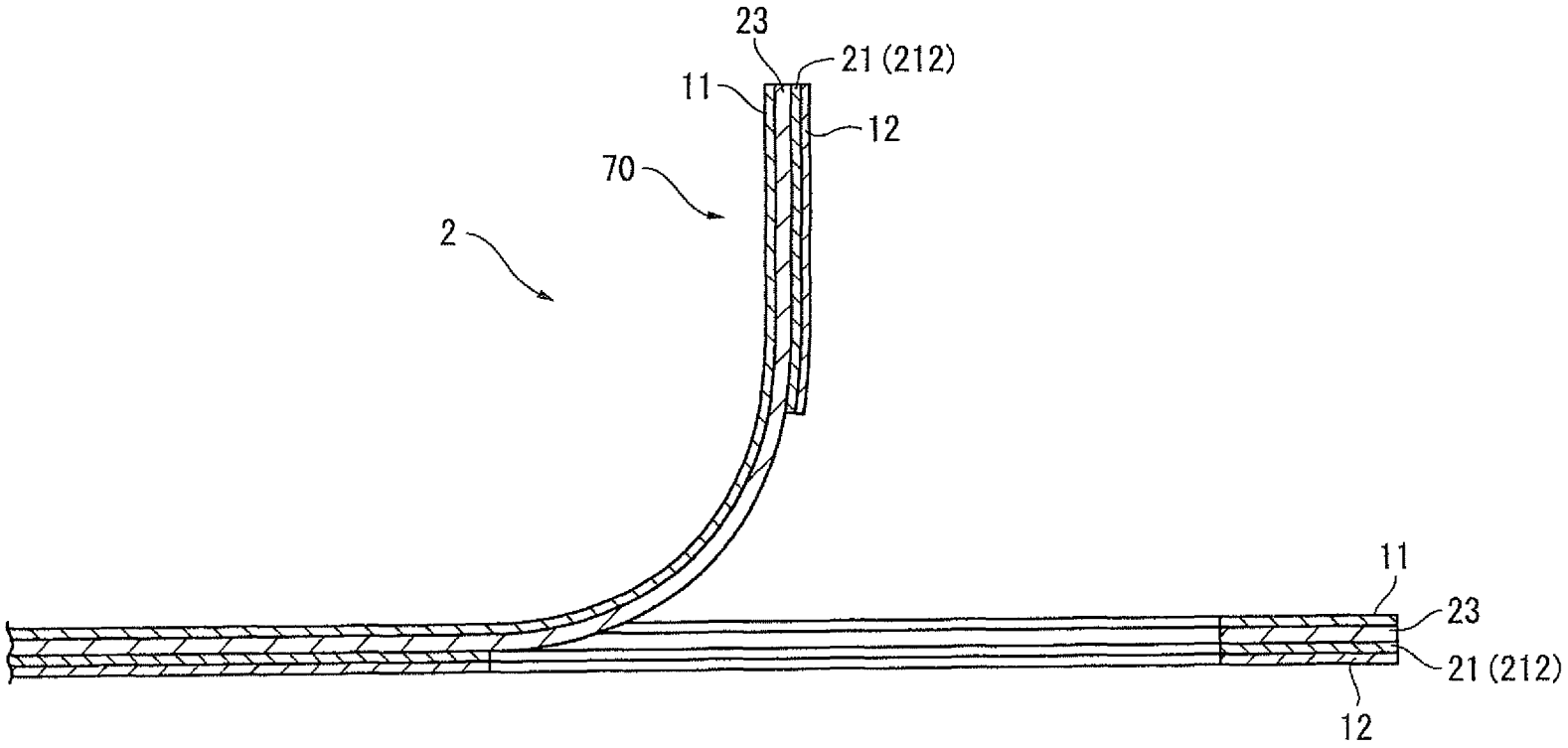
FIG. 8B is a schematic view showing advancement of the unsealed state of the bag with the reclosable tape of the second embodiment.

FIGS. 8A and 8B are schematic views each showing the unsealed state of the bag with the reclosable tape of the second embodiment, where the upper side film 11, the cut tape 23, the mounting base part 212 of the male fastener part 21, and the tab 70 on the lower side film 12 adhered to one another are simultaneously pulled when the tab 70 is pulled as described above (FIG. 8A). However, since the hole portion 50*b* is formed as the easily unsealable structure 50 on the mounting base part 212 of the male fastener part 21 and the lower side film 12 in the bag 2 with the reclosable tape of the present embodiment (FIG. 8B), the mounting base part 212 of the male fastener part 21 and the lower side film 12 are not ripped off once the ripping reaches the hole portion 50*b* and only the cut tape 23 and the upper side film 11 are ripped to form the opening.

The bag 2 with the reclosable tape of the present embodiment has the following advantage in addition to the advantages (1) to (3) of the bag 1 with the reclosable tape of the first embodiment described above.

(4) Since the hole portion 50*b* as the easily unsealable structure is also provided on the lower side film 12 in the unsealing start part 30 not provided with the reclosable tape 20, the lower side film 12 can be properly prevented from being cut to the content side, and the force required in unsealing for the first time can further be reduced.

It is to be understood that the embodiments described above are only embodiments illustrating the present invention, and the present invention is not limited to the embodiments but includes modifications and improvements as long as the object of the present invention can be achieved. Specific structure and shape of the components in the present invention may be designed in any manner as long as the object of the present invention can be achieved.

For example, the hole portions 50*a* and 50*b* are formed as a specific example of the easily unsealable structure 50 in the embodiments described above, but the arrangement is not limited thereto. Instead of forming the hole portion 50*b*, a portion (non-adhesive portion 51) where the lower side film 12 and the cut tape 23 are not adhered to each other may be formed at a position corresponding to the hole portion 50*b*.

Figure 9:
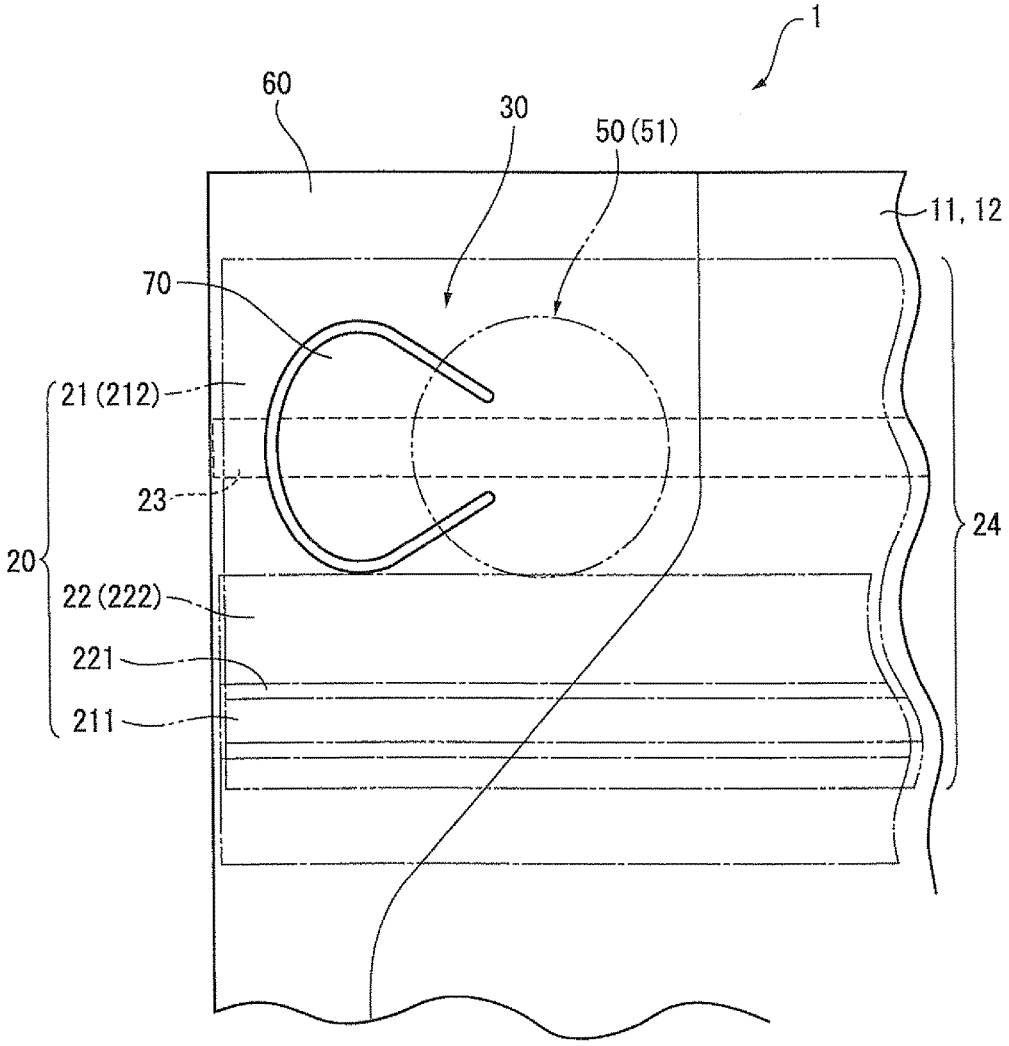
FIG. 9 is a front view showing another aspect of the vicinity of the unsealing start part formed on which the tab is formed in the bag with the reclosable tape of the present invention.
Figure 10:
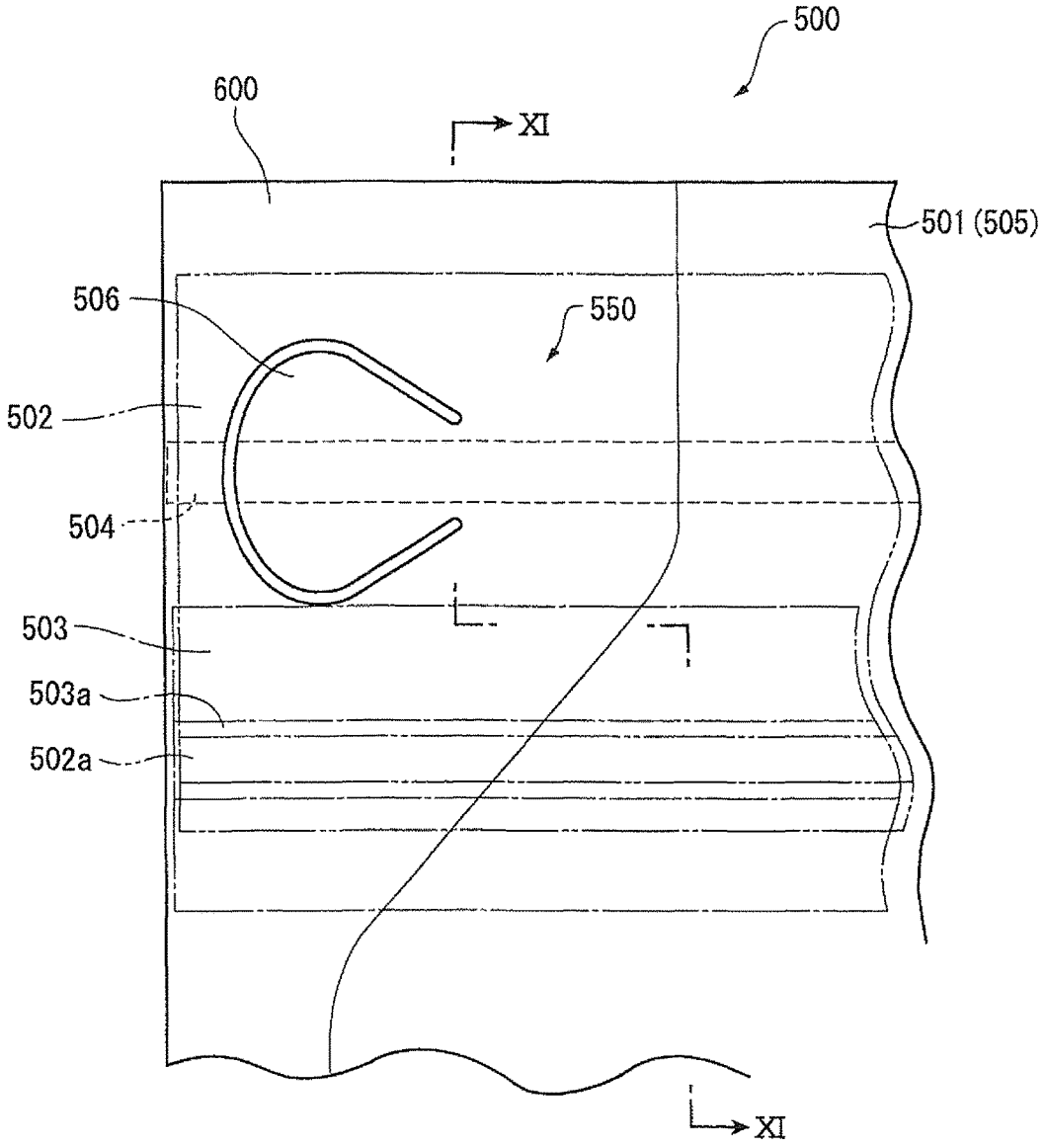
FIG. 10 is a front view of the vicinity of an unsealing start part of a conventional bag with a reclosable tape.
Figure 11:
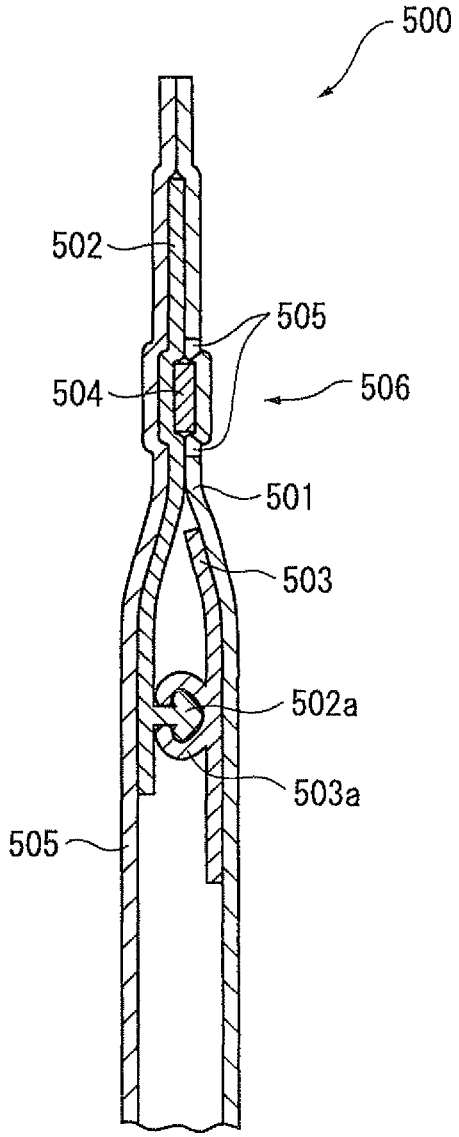
FIG. 11 is a cross sectional view taken along the line XI-XI of FIG. 10.

FIG. 9 is a front view showing another aspect of the vicinity of the unsealing start part 30 in which the tab 70 is formed in the bag 1 with the reclosable tape of the present invention, showing the aspect in which the easily unsealable structure 50 is formed by a portion (non-adhesive portion 51) where the mounting base part 212 of the male fastener part 21 and the cut tape 23 are not adhered to each other.

As shown in FIG. 9, by providing the non-adhesive portion 51 in the unsealing start part 30, the lower side film 12 will not be ripped off when the cut tape 23 is pulled to unseal. With the arrangement, the effects similar to the bags 1 and 2 with the reclosable tape of the first embodiment and the second embodiment described above can be obtained, so that unsealing can be carried out with a small force.

Although not shown, another example of the easily unsealable structure 50 may be a structure in which the thickness of the male fastener part 21 in the unsealing start part 30 is thinner than other portions. With the arrangement, the mounting base part 212 is properly broken from the thinner portion and the mounting base part 212 will not be further ripped off when the cut tape 23 is pulled up to unseal the bag body 10, so that unsealing can be easily and simply carried out with a small force.

An aspect in which the easily unsealable structure 50 (e.g., 50*a*) is formed on the mounting base part 212 of the male fastener part 21 adjacent to the cut tape 23 in the unsealing start part 30 formed on the side seal part 60 of the bag body 10 is exemplified in the embodiments described above, but the arrangement is not limited thereto. An arrangement in which the cut tape 23 and the female fastener part 22 are adjacent to each other may be employed. In such case, the mounting base parts 212 and 222 of both fastener parts 21 and 22 are so arranged that the mounting base part 222 of the female fastener part 22 preferably may have a width wider than the mounting base part 212 of the male fastener part 21 with regard to.

In addition, specific structures, shapes and the like in the embodiments of the present invention may be others as long as the object of the present invention can be achieved.

EXAMPLES

The present invention will now be further described in detail with examples and comparisons, but it should be noted that the present invention should not be limited to contents described in the examples and the like in any way.

Example 1

The bag 1 with the reclosable tape shown in FIGS. 1 to 3 (first embodiment) was manufactured through the following method.

First, the reclosable tape 20 including the male fastener part 21 and the female fastener part 22 was manufactured using a low-density polyethylene resin having a melt flow rate (MFR) of 1.5 g/10 min. (JIS K7210 230° C., 21.2 N load) and a density of 926 kg/m$^3$. The hole portion 50*a* shown in FIGS. 2 and 3 was formed on the mounting base part 212 of the male fastener part 21.

The packaging material was prepared using a laminated film in which a biaxial oriented polyethylene terephthalate film (thickness of 12 μm) and a linear low-density polyethylene film (thickness of 50 μm) are dry laminated. After attaching a biaxial oriented polyethylene terephthalate (PET) tape (width of 3 mm, thickness of 12 μm), both surfaces of which are applied with thermoset adhesive, to the back surface of the upper side film 11 as the cut tape 23, the above described reclosable tape 20 was thermally welded so that the back surface of the upper side film 11 and the mounting base part 212 of the male fastener part 21 were thermally welded in such a manner that the cut tape 23 and the hole portion 50*a* overlap each other. The bag 1 with the reclosable tape of the present invention was obtained by thermally welding the circumferences of the packaging materials and forming the heat seal part (two opposing sides at both ends defining the side seal part 60).

The tab 70 in the unsealing start part 30 was formed such that the shape thereof corresponded to the shape of FIG. 4B (C-shaped tab) and that an angle $\theta_2$ formed by the ripping start part of the C-shaped tab and the advancing direction was set to 70 degrees. The intersection Y of FIG. 4B was arranged to be on the inner side of the side seal part 60.

Example 2

In the bag with the reclosable tape of Example 1, the bag 1 with the reclosable tape of the present invention was obtained using a method similar to Example 1 except that the angle $\theta_2$ formed by the ripping start part of the C-shaped tab was changed from 70 degrees to 40 degrees.

Example 3

In the bag with the reclosable tape of Example 1, the bag 2 with the reclosable tape of the present invention was obtained using a method similar to Example 1 except that the hole portion 50*b* was also formed on the lower side film 12 similarly to the hole portion on the mounting base part 212 of the male fastener part 21 (second embodiment shown in FIGS. 7, 8A, and 8B).

Example 4

In the bag with the reclosable tape of Example 1, the bag 1 with the reclosable tape of the present invention was obtained using a method similar to Example 1 except that sealing was not provided to a position on which the hole portion 50*a* is formed in the male fastener part 21 so as to provide the non-adhesive portion 51 in the unsealing start part 30 to form the side seal part 60, as shown in FIG. 9.

Comparison 1

In the bag with the reclosable tape of Example 1, a bag with the reclosable tape was obtained using a method similar to Example 1 except that the hole portion as the easily unsealable structure was not formed on the mounting base part of the male fastener.

Test Example 1

"Feeling of resistance in unsealing", "resistance value in unsealing" and "presence/absence of film cut in unsealing" were checked, compared, and evaluated through the following conditions for the bags obtained in Examples 1 to 4 and in Comparison 1. The results are shown in Table 1.

Feeling of Resistance in Unsealing

The feeling of resistance in unsealing by picking up the tab part of the bag with the reclosable tape with a hand was judged in accordance with the following criteria.

Criteria

| Judgment | content |
|---|---|
| ◎ | no resistance at all, very easy to open |
| ○ | no resistance, easy to open |
| X | with resistance, hard to open |

Resistance Value in Unsealing

The resistance value (N) in unsealing by picking up the tab part of the bag with the reclosable tape with a commercially available digital force gauge was measured.

Presence of Film Cut in Unsealing

The presence/absence of cut on the content side film (lower side film) in unsealing by picking up the tab part of the bag with the reclosable tape with a hand was checked.

Results

TABLE 1

| | Feeling of resistance in unsealing | Resistance value (N) in unsealing | Cut of film | Overall evaluation |
|---|---|---|---|---|
| Example 1 | ○ | 10 | NO | ○ |
| Example 2 | ○ | 5 | NO | ○ |
| Example 3 | ○ | 3 | NO | ○ |
| Example 4 | ○ | 3 | NO | ○ |
| Comparison 1 | x | 30 | YES | x |

As apparent from the results of Table 1, the feeling of resistance in unsealing was satisfactory and unsealing could be performed very easily for the bags with the reclosable tape of Examples 1 to 4 that have the easily unsealable structure in the unsealing start part. In addition, the resistance value in unsealing was small, and particularly Example 2 in which the angle $\theta_2$ formed by the ripping start part of the C-shaped tab is 40 degrees, Example 3 in which the hole portion was also formed on the lower side film, and Example 4 in which the non-adhesive portion was arranged as the easily unsealable structure showed excellent result. Furthermore, the cut of the film on the content side in unsealing was not observed in the bags with the reclosable tape of Examples 1 to 4. Therefore, it was verified that the bag with the reclosable tape of the present invention could be unsealed with a small force and with ease.

In contrast, the bag with the reclosable tape of Comparison 1 that is not provided with the easily unsealable structure had resistance in unsealing, was very hard to unseal, and showed large resistance value in unsealing. In addition, the cut of the film on the content side was observed in unsealing, and thus, unsealing performance was significantly inferior to the bag with the reclosable tape of the above-mentioned Examples.

INDUSTRIAL APPLICABILITY

The bag with the reclosable tape of the present invention is widely used as the packaging material for sealing and packaging various articles such as powder, food, medical supplies, electronic components, office supplies, and the like, regardless of the shape of the bag such as gazette bag and pillow bag.

The invention claimed is:

1. A bag comprising:

a bag body comprising at least one film, a cut tape bonded to an inner surface of said at least one film of said bag body, the cut tape being configured so that only the film to which the cut tape is bonded over the entire length of the cut tape, is ripped over the entire length of the cut tape to form an opening in the bag body; and at least one mounting base part is provided on the cut tape, said at least one mounting base part is positioned between the cut tape and the at least one film and extends in a direction parallel to the longitudinal direction of the cut tape, wherein said at least one mounting base part is configured not to be ripped over the entire length of the cut tape, a hole portion or a weak line wherein said hole portion or a weak line is provided only in said mounting base part where the cut tape is bonded, over the width direction of the cut tape, said hole portion or a weak line penetrates said at least one mounting base part.

2. The bag according to claim 1, wherein the cut tape is not exposed to the exterior of the bag body through the hole portion or the weak line.

3. The bag according to claim 1, further comprising a male fastener and a female fastener provided on the inner surface of said at least one film to which the cut tape is bonded over said cut tape's entire length, the male fastener and the female fastener being configured to be fitted with each other.

4. The bag according to claim 3, wherein each of the male fastener and the female fastener has a mounting base part, and each of the male fastener and the female fastener is bonded to the inner surface of the at least one film through the mounting base part.

5. The bag according to claim 3, wherein the cut tape is bonded to the inner surface of the at least one film at a position between the part of the inner surface of the at least one film at which the male fastener or the female fastener is bonded to the at least one film and another part of the inner surface of the at least one film at which the other male fastener or the female fastener is bonded to the bag.

6. The bag according to claim 3, wherein the cut tape is bonded to the at least one film in parallel to a longitudinal direction of the male fastener and the female fastener.

7. The bag according to claim 4, wherein the mounting base part comprises a first mounting base part for the male fastener and a second mounting base part for the female fastener, one of the first and second mounting base parts being wider than the other of the first and second mounting base parts, and wherein the at least one film is overlapped to define at least two bag walls wherein said bag walls have an inner surface and an outer surface, and said first and second mounting base parts being bonded to only one and the same inner surface of the bag walls.

8. The bag according to claim 1, further comprising a packaging material wherein said packaging material is overlapped to define an at least one bottom side or bottom surface, at least one side surface or surface lateral to the bottom side or bottom surface, and at least one side or surface opposite to the bottom side or bottom surface.

9. The bag according to claim 8, wherein the at least one side or surface opposite to the bottom side or bottom surface is not bonded.

10. The bag according to claim 8, wherein at least a part of the lateral sides or surface that overlap are adhered to each other.

11. The bag according to claim 8, wherein said at least one side or surface lateral to the bottom side or bottom surface comprises two lateral sides or surfaces wherein at least a part of said two lateral sides or surfaces are bonded to each other to define a bonded portion, and a part of the cut tape is overlapped at the bonded portion to define an overlapped bonded portion, and the hole portion or the weak line is provided in the overlapped bonded portion.

12. The bag according to claim 11, further comprising a tab provided in the overlapped portion.

13. A bag comprising:

a bag body comprising a packaging material that is overlapped to define an at least one bottom side or bottom surface, at least one side or surface lateral to the bottom side or bottom surface and at least one side or surface opposite to the bottom side or bottom surface;

a cut tape bonded to an inner surface of the bag body, the cut tape being configured so that only the bag body surface on which the cut tape is bonded over the entire length of the cut tape, is ripped over the entire length of the cut tape; and at least one mounting base part is provided on the cut tape, said at least one mounting base part is positioned between the cut tape and the bag body and extends in a direction parallel to the longitudinal direction of the cut tape, wherein said at least one mounting base part is configured not to be ripped over the entire length of the cut tape, a hole portion or a weak line wherein said hole portion or a weak line is provided only in said mounting base part where the cut tape is bonded, over the width direction of the cut tape, said hole portion or a weak line penetrates said at least one mounting base part.

14. The bag of claim 13 wherein at least one of the bottom side or surface, at least one side or surface lateral to the bottom side or surface or at least one side or surface opposite to the bottom side or surface is open.

15. The bag according to claim 13, wherein the cut tape is not exposable to the exterior of the bag body through the hole portion or the weak line.

16. The bag according to claim 13, further comprising a male fastener and a female fastener provided on the inner surface of the bag body, the male fastener and the female fastener being configured to be fitted with each other.

17. The bag according to claim 16, wherein each of the male fastener and the female fastener have a mounting base part, and each of the male fastener and female fastener is bonded to the inner surface of the bag body through the mounting base part.

18. A bag comprising:

a bag body comprising at least one film wherein said at least one film comprises a first inner surface and a second inner surface, wherein said first and second inner surfaces are positioned opposed to each other, a cut tape bonded to the first inner surface of a bag body film over the entire length of the cut tape, the cut tape being configured so that only said at least one film to which the cut tape is bonded over the entire length of the cut tape is ripped over the entire length of the cut tape to form an opening in the bag body;

at least one mounting base part is provided on the cut tape, said at least one mounting base part is positioned between the cut tape and the at least one film and extends in a direction parallel to the longitudinal direction of the cut tape, wherein said at least one mounting base part is configured not to be ripped over the entire length of the cut tape, and a hole portion or a weak line wherein said hole portion or a weak line is provided only in said mounting base part where the cut tape is bonded, over the width direction of the cut tape, said hole portion or a weak line penetrates said at least one mounting base part.

19. The bag according to claim 18, wherein the cut tape is not exposed to the exterior of the bag body through the hole portion or the weak line.

* * * * *